US012788076B2

(12) United States Patent
Li et al.

(10) Patent No.: US 12,788,076 B2
(45) Date of Patent: Nov. 10, 2026

(54) GARMENT

(71) Applicant: Shenzhen Lute Jiacheng Supply Chain Management Co., Ltd., Shenzhen (CN)

(72) Inventors: Lan Li, Shenzhen (CN); Ping Yan, Shenzhen (CN); Ting Zhou, Shenzhen (CN)

(73) Assignee: Shenzhen Lute Jiacheng Supply Chain Management Co., Ltd., Shenzhen (CN)

( * ) Notice: Subject to any disclaimer, the term of this patent is extended or adjusted under 35 U.S.C. 154(b) by 0 days.

(21) Appl. No.: 19/437,324

(22) Filed: Dec. 31, 2025

(65) Prior Publication Data

US 2026/0123692 A1 May 7, 2026

(30) Foreign Application Priority Data

Oct. 17, 2025 (CN) ..... 202522210578.6

(51) Int. Cl.
*A41C 3/04* (2006.01)

(52) U.S. Cl.
CPC ..... *A41C 3/04* (2013.01)

(58) Field of Classification Search
CPC ..... A41C 3/04
USPC ..... 450/36
See application file for complete search history.

(56) References Cited

U.S. PATENT DOCUMENTS

| | | | | |
|---|---|---|---|---|
| 2011/0092134 | A1* | 4/2011 | Alva | A61M 1/062 450/39 |
| 2016/0021939 | A1* | 1/2016 | Taheri | A61M 1/062 450/36 |
| 2018/0000168 | A1* | 1/2018 | Alva | A41D 1/215 |
| 2019/0289926 | A1* | 9/2019 | Abbaszadeh | A41C 3/04 |
| 2020/0154792 | A1* | 5/2020 | Abbaszadeh | A61M 1/062 |
| 2021/0345690 | A1* | 11/2021 | Stanton | A41C 3/04 |
| 2023/0320435 | A1* | 10/2023 | Carlino | A41C 3/04 450/36 |

* cited by examiner

*Primary Examiner* — Gloria M Hale

(57) ABSTRACT

The present application discloses a garment comprising a breast pump functional layer which includes a first panel, a second panel, and a third panel. The first panel is joined to the second panel to form a first seam at a joining region, and the first panel is joined to the third panel to form a second seam at a joining region. The second panel and the third panel are joined to a same side edge of the first panel. The second panel and the third panel are joined at least partially to form a third seam at a joining region, with an opening formed at a non-joined region. The opening is configured to allow at least a portion of a breast pump to pass therethrough for milk pumping.

18 Claims, 7 Drawing Sheets

GARMENT

CROSS-REFERENCE TO RELATED APPLICATIONS

The present application claims priority to Chinese Patent Application No. 202522210578.6, filed on Oct. 17, 2025, the entire contents of which are incorporated herein by reference.

TECHNICAL FIELD

The present application relates to the technical field of maternal and baby products, particularly to a garment.

BACKGROUND

In the field of modern maternal and infant products, nursing garments that combine discretion with functionality, particularly those integrating breast pump features, are garnering increasing attention. A core design requirement for such garments is to provide an access port for the breast pump and ensure its stable support without the need for complete removal, while also balancing wearing comfort and aesthetic appeal.

Currently, such garments on the market face two major technical challenges in their structural design:

The first category involves breast pump functional layers adopting a three-panel joined structure. Although this structure can provide relatively better breast containment space through multi-panel cutting, forming a more three-dimensional cup shape, the opening is typically formed at the convergence point of the three fabric panels. This design results in a complex edge structure of the opening with concentrated seams. During use, the wearer's nipple area is highly susceptible to friction or even pinching against the edges or seam points of the multiple fabric panels, causing significant discomfort and pain, which severely impacts the user experience.

The second category of design adopts a simpler two-panel structure to avoid the nipple-pinching issue. For example, the opening is positioned between the two fabric panels, simplifying the treatment of the opening edge. However, due to the fewer number of fabric panels and reduced cutting flexibility, this two-panel structure often struggles to provide sufficient depth and width for breast containment space. Consequently, the garment tends to flatten the chest appearance when worn, lacking an aesthetically pleasing three-dimensional shape. Furthermore, to secure the breast pump, the fabric may exert unnatural pressure and constriction on the breast. Prolonged wear can lead to discomfort and may potentially affect pumping efficiency.

SUMMARY

In view of the deficiencies in the prior art, embodiments of the present application provide a garment, which is capable of solving the problems of insufficient breast containment space in the breast pump functional layer of existing garments or wearing discomfort caused by the opening for breast pump support.

In order to solve the above technical problem, one embodiment of this application proposes a garment comprising: a breast pump functional layer, the breast pump functional layer comprising a first panel, a second panel, and a third panel; wherein the first panel is joined to the second panel to form a first seam; wherein the first panel is joined to the third panel to form a second seam; wherein the second panel and the third panel are joined to a same side edge of the first panel; wherein the second panel and the third panel are joined at least partially to form a third seam, and an opening is formed at a non-joined region; and wherein the opening is configured to allow at least a portion of a breast pump to pass therethrough for milk pumping, the second panel and the third panel are configured to provide support to the breast pump when at least a portion of the breast pump is inserted into the opening.

In one embodiment, the opening is formed solely between the second panel and the third panel.

In one embodiment, the first seam and the second seam are connected with a smooth transition.

In one embodiment, the breast pump functional layer has an underarm edge adjacent to a wearer's underarm when worn, and wherein the first seam extends from a lower edge of the breast pump functional layer to a position adjacent to a first end of the second seam, and the second seam extends from the first end to the underarm edge of the breast pump functional layer.

In one embodiment, the first seam and the second seam are both curved, and wherein the first panel, the second panel, and the third panel are joined to form the breast pump functional layer having an outwardly convex bowl shape.

In one embodiment, the second panel and the third panel at least partially overlap at a location of the opening or at locations adjacent to two ends of the opening.

In one embodiment, the third seam comprises a first sub-seam and a second sub-seam, the opening is formed between the first sub-seam and the second sub-seam, at the first sub-seam the second panel is on an outer side of the third panel, and at the second sub-seam the second panel is on an inner side of the third panel.

In one embodiment, the second panel has a first edge adjacent to the third panel, and the third panel has a second edge adjacent to the second panel; the opening is formed between the first edge and the second edge; the second panel is formed by folding a fabric along the first edge; and the third panel is formed by folding another fabric along the second edge, thereby reducing friction of the first edge and the second edge against a wearer's nipple.

In one embodiment, the breast pump functional layer further comprises a fourth panel, the fourth panel is disposed to at least partially overlap with the first panel and the third panel, the fourth panel does not cover the opening, and an elastic modulus of the fourth panel is greater than elastic moduli of the first panel, the second panel, and the third panel.

In one embodiment, the fourth panel is joined to the breast pump functional layer at least at a junction of a neckline edge and the underarm edge of the breast pump functional layer.

In one embodiment, further comprising a cover layer, wherein a portion of the cover layer is connected to the breast pump functional layer, the cover layer is disposed to be stacked with the breast pump functional layer, the cover layer is configured to at least partially cover the opening, and the cover layer is capable of being pulled open under an external force to expose the opening.

In one embodiment, the cover layer and the breast pump functional layer are together detachably connectable to the shoulder strap.

In one embodiment, an upper end of the support strap is connected to the shoulder strap, and a lower end of the support strap is connected to the breast pump functional layer or the cover layer.

Another embodiment provided by the present application is: a garment comprising: a breast pump functional layer, the breast pump functional layer comprising a first panel and a second panel; wherein the first panel and the second panel are joined at least partially to form a seam, and an opening is formed at a non-joined region; wherein the opening is configured to allow at least a portion of a breast pump to pass therethrough for milk pumping, the first panel and the second panel are configured to provide support to the breast pump when at least a portion of the breast pump is inserted into the opening; and wherein the first panel and the second panel at least partially overlap at a location of the opening or at locations adjacent to two ends of the opening.

In one embodiment, the seam comprises a first sub-seam and a second sub-seam, the opening is formed between the first sub-seam and the second sub-seam, at the first sub-seam the first panel is on an outer side of the second panel, and at the second sub-seam the first panel is on an inner side of the second panel.

In one embodiment, the first panel has a first edge adjacent to the second panel, and the second panel has a second edge adjacent to the first panel; the opening is formed between the first edge and the second edge; the first panel is formed by folding a fabric along the first edge; and the second panel is formed by folding another fabric along the second edge, thereby reducing friction of the first edge and the second edge against a wearer's nipple.

Yet another embodiment provided by the present application is: a garment comprising: a breast pump functional layer having an opening formed therein, the opening configured to allow at least a portion of a breast pump to pass therethrough for milk pumping, the breast pump functional layer is configured to provide support to the breast pump when at least a portion of the breast pump is inserted into the opening; and a support panel disposed to at least partially overlap with the breast pump functional layer; wherein the support panel does not cover the opening; and wherein an elastic modulus of the support panel is greater than an elastic modulus of the breast pump functional layer.

In one embodiment, the support panel is joined to the breast pump functional layer at least at a junction of a neckline edge and an underarm edge of the breast pump functional layer.

In one embodiment, the breast pump functional layer comprises: a first panel, a second panel, and a third panel; wherein the first panel is joined to the second panel to form a first seam; wherein the first panel is joined to the third panel to form a second seam; wherein the second panel and the third panel are joined to a same side edge of the first panel; and wherein the second panel and the third panel are joined at least partially to form a third seam, and the opening is formed at a non-joined region.

In one embodiment, the support panel is disposed to at least partially overlap with the first panel and the third panel of the breast pump functional layer.

In the embodiments of the present application, the garment is configured to include a breast pump functional layer, which comprises a first panel, a second panel, and a third panel. The first panel is joined to the second panel to form a first seam at the joining region, and the first panel is joined to the third panel to form a second seam at the joining region. The second panel and the third panel are joined to the same side edge of the first panel. The second panel and the third panel are joined at least partially to form a third seam at the joining region, with an opening formed at the non-joined region. The opening is configured to allow at least a portion of a breast pump to pass therethrough for pumping milk, the second panel and the third panel are configured to provide support to the breast pump when at least a portion of the breast pump is inserted into the opening. By employing three-dimensional tailoring constituted through the joint splicing of the first, second, and third panels, the breast pump functional layer facilitates the design of cup capacity. It can be assembled as needed to fit different breast shapes, forming a space with sufficient depth that conforms to the natural contour of the breast. This effectively avoids the chest flattening and sense of pressure caused by traditional two-panel structures, resulting in a more aesthetically pleasing and comfortable breast shape when worn. Simultaneously, by positioning the opening for breast pump support between the second and third panels, the risk of nipple pinching and friction is reduced, thereby enhancing wearing comfort. Consequently, this configuration ensures the supporting functionality of the opening while facilitating the design of breast containment capacity for the breast pump functional layer and improving overall wearing comfort.

BRIEF DESCRIPTION OF THE DRAWINGS

To further clarify the technical solutions in the embodiments of this application or the prior art, a brief introduction to the drawings that need to be used in the description of the embodiments or prior art will be provided below. It is obvious that the drawings described below are merely some embodiments of this application, and for those skilled in the art, additional drawings may be obtained based on the structures shown in these drawings without requiring inventive effort.

Figure 1:
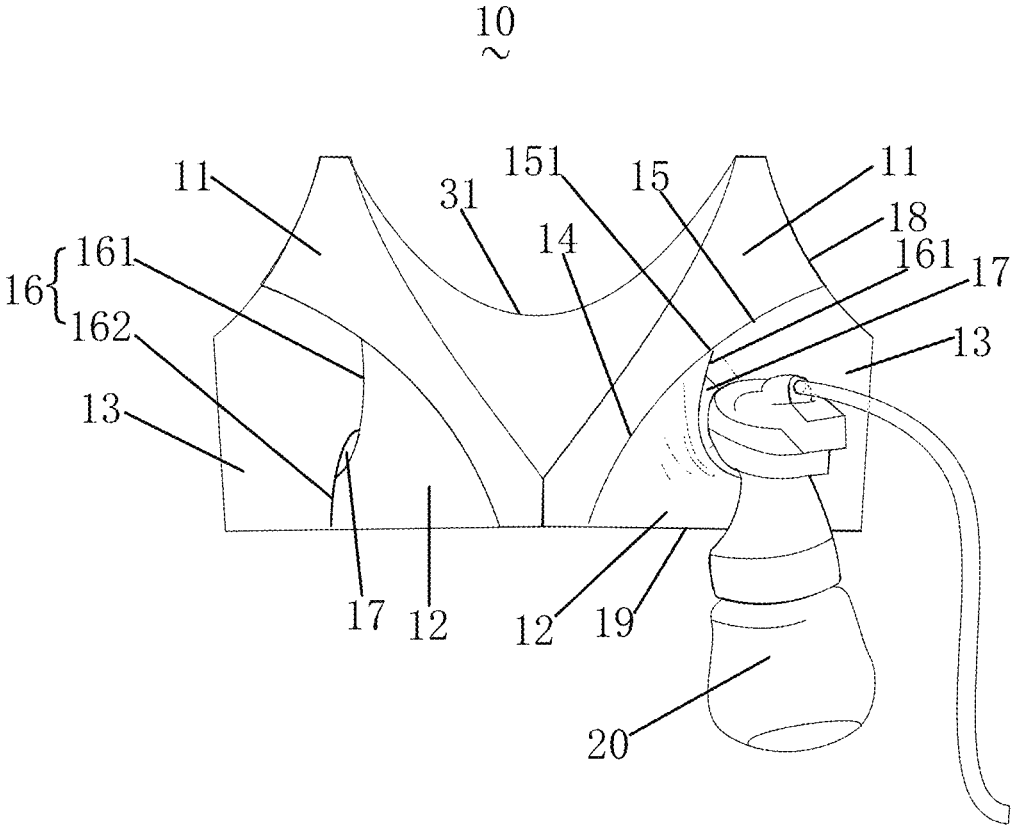
FIG. 1 is a schematic front view of a breast pump functional layer according to an embodiment of the present application.

The realization, functional characteristics, and advantages of the objectives of this application will be further explained in combination with the embodiments, with reference to the drawings.

DETAILED DESCRIPTION OF THE EMBODIMENTS

In this application, the terms "provided," "disposed," and "connected" should be broadly understood. For example, they can refer to fixed connections, detachable connections, or integrated structures. They may indicate mechanical connections or electrical connections, direct connections, or indirect connections through an intermediary, or they may refer to internal communication between two devices, components, or parts. A person skilled in the art can understand the specific meaning of these terms in this application according to the context.

The terms "center," "longitudinal," "transverse," "length," "width," "thickness," "top," "bottom," "front," "back," "left," "right," "vertical," "horizontal," "inner," "outer," "radial," and "circumferential" indicate directional or positional relationships based on the orientation or positional relationships shown in the figures. These terms are used solely to simplify and clarify the description of the present application and should not be interpreted as limiting the invention to a specific orientation, construction, or operation.

Additionally, the terms "first" and "second" are used only for descriptive purposes and should not be understood as indicating relative importance or implying the number of features. Therefore, a "first" or "second" feature may explicitly or implicitly include one or more of that feature. In the description of this application, "multiple" means at least two, such as two or three, unless otherwise explicitly specified.

Moreover, the above terms, in addition to indicating directional or positional relationships, may also have other meanings. For example, the term "top" may also refer to attachment or connection relationships. A person skilled in the art can understand these terms according to the specific context.

Breastfeeding offers numerous benefits for both infants and nursing women. Breast milk contains all the essential nutrients needed for an infant's growth and development. Breastfed infants tend to be healthier, with fewer incidences of middle ear infections and respiratory tract infections, and they have a lower risk of allergies, cancer, childhood diabetes, and obesity. They are also less prone to heart disease, eczema, and asthma. For breastfeeding women, it can reduce the chances of postpartum bleeding and anemia, aid in uterine recovery, and help burn an additional 500 calories per day.

However, due to work schedules and other time demands, not all nursing women can feed their babies on demand. Consequently, many use breast pumps to extract and store breast milk for feeding. Abreast pump system typically includes a breast shield, a funnel-shaped device with a conical area that fits against the breast with the nipple centered in the shield. When negative pressure is applied, the nipple is drawn into the shield's tubular section, usually into the nipple channel. The nipple channel connects to other components of the breast milk collection kit, allowing periodic negative pressure to be applied inside the breast shield. This connection also provides a flow path for the expressed milk, enabling its collection in a container. The container can be a breast milk bottle with a screw cap, which can later be used as a baby feeding bottle. Nursing women often need to hold the breast shield in place to express milk.

It is foreseeable that securing the breast shield by hand is inconvenient and restricts what tasks women can perform during pumping. Although various bras and nursing garments have been developed to hold the breast shield, they generally do not secure it well, requiring adjustments or repositioning.

Figure 2:
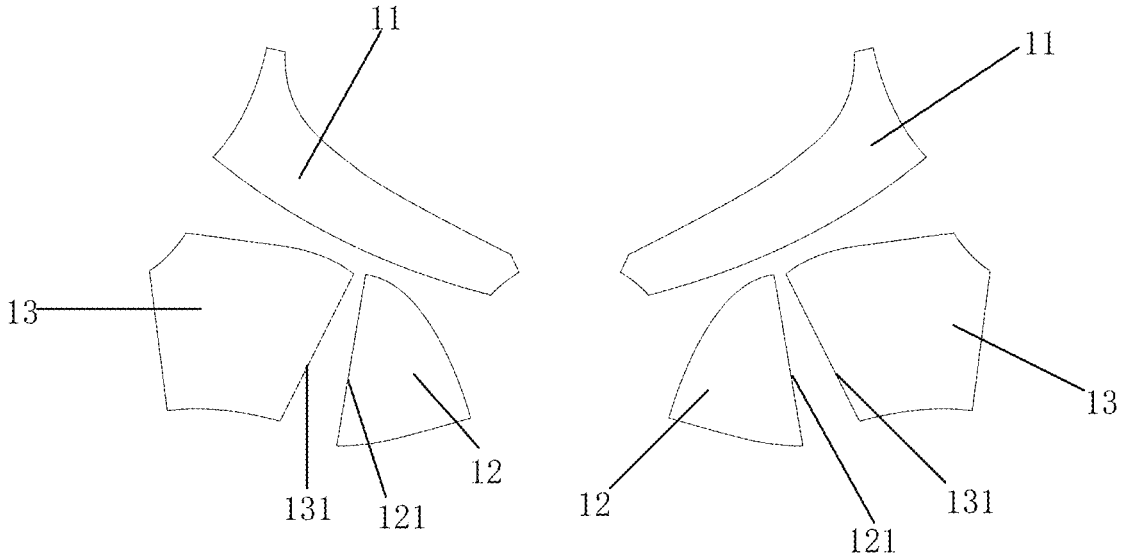
FIG. 2 is an exploded schematic view of a first panel, a second panel, and a third panel according to a first embodiment of the present application.
Figure 3:
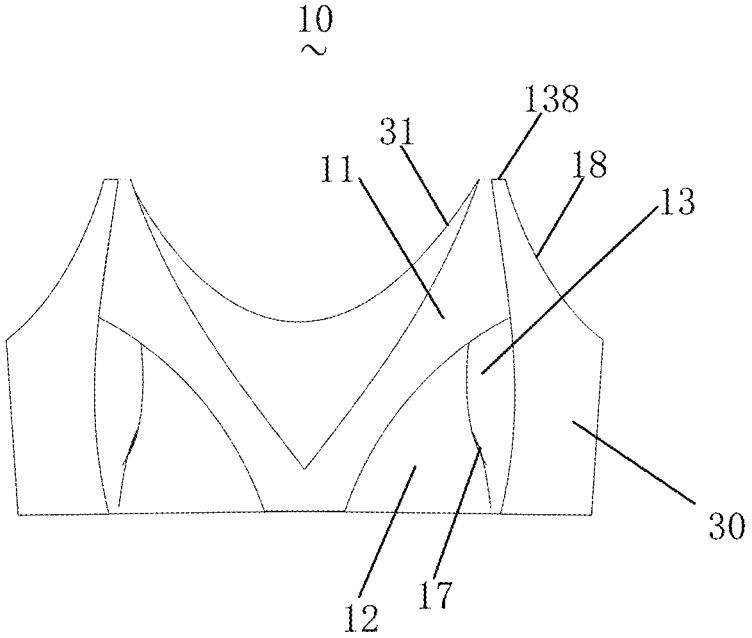
FIG. 3 is a schematic rear view of the breast pump functional layer according to the first embodiment of the present application.
Figure 4:
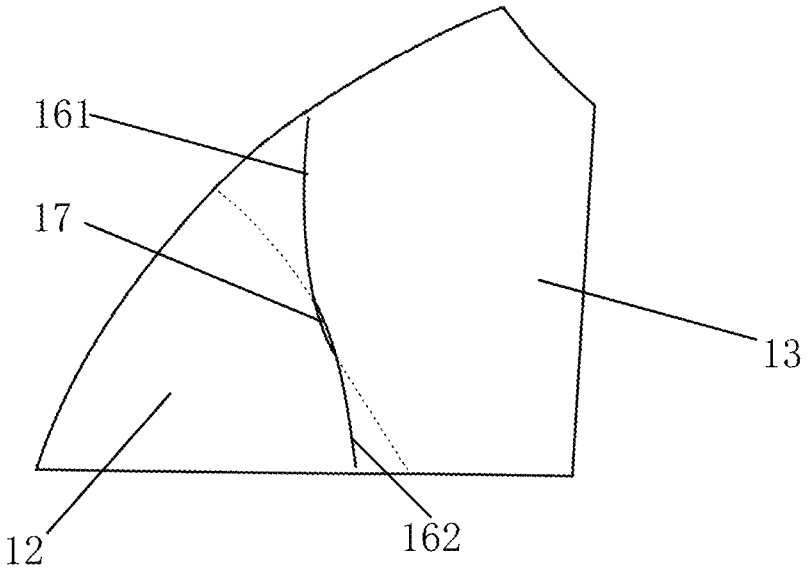
FIG. 4 is a schematic view illustrating a joining manner between the second panel and the third panel according to the first embodiment of the present application.
Figure 5:
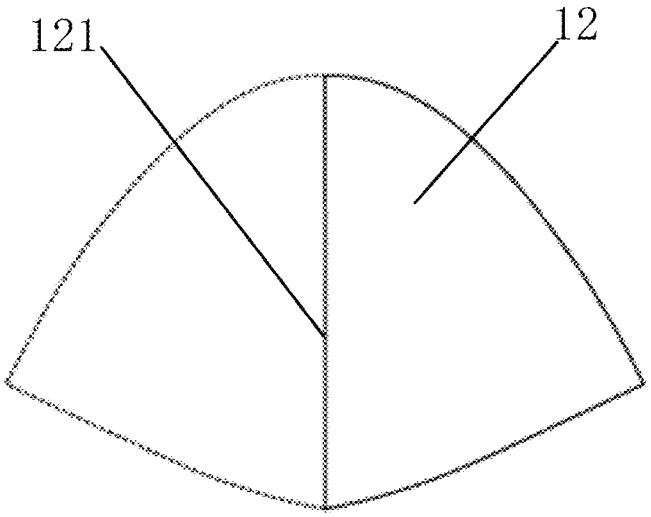
FIG. 5 is a schematic view illustrating the second panel being folded along a first edge according to the first embodiment of the present application.
Figure 6:
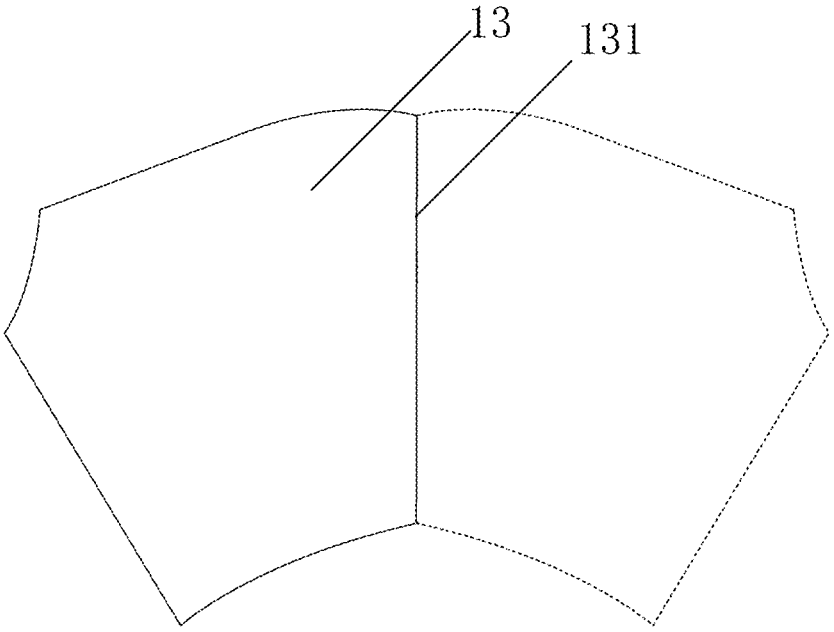
FIG. 6 is a schematic view illustrating the third panel being folded along a second edge according to the first embodiment of the present application.
Figure 7:
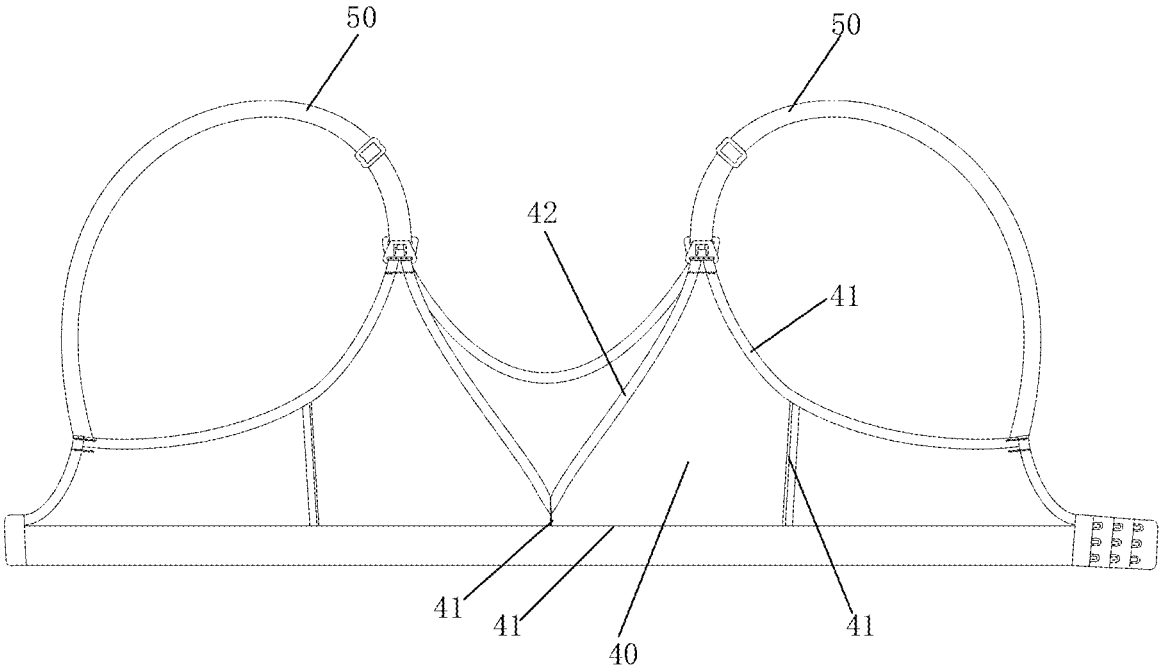
FIG. 7 is a schematic front view of a garment according to the first embodiment of the present application.
Figure 8:
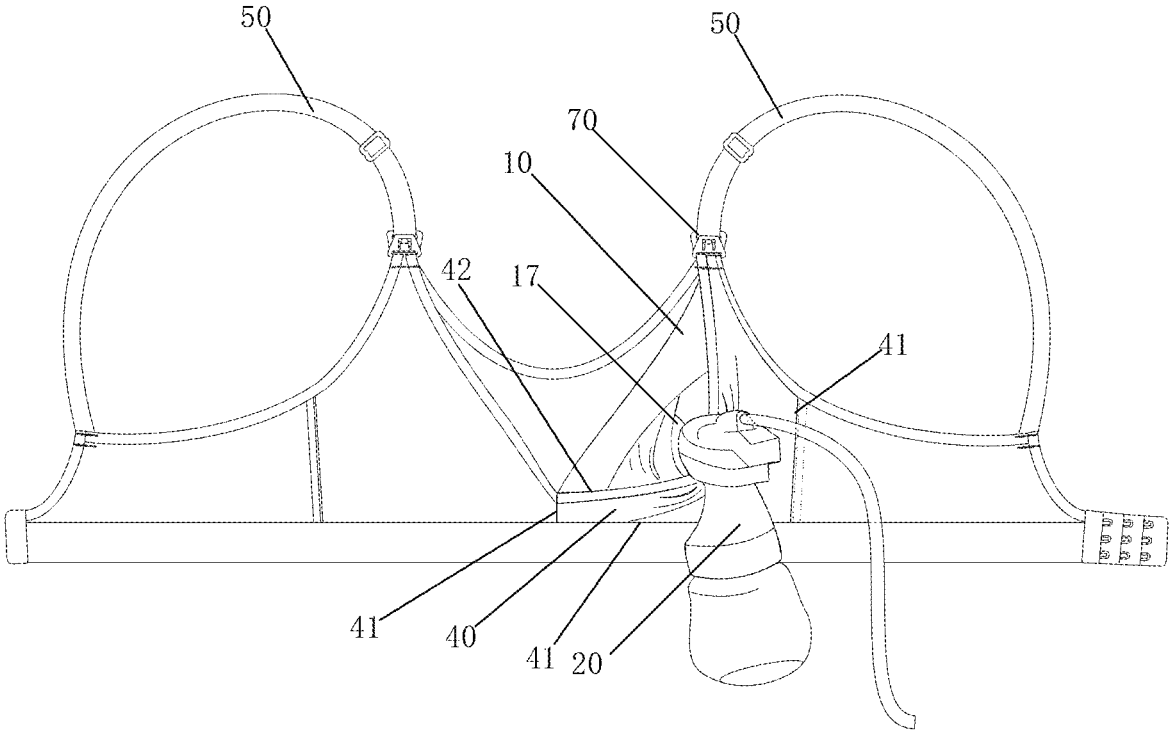
FIG. 8 is a schematic view illustrating a pumping state of the garment according to the first embodiment of the present application.
Figure 9:
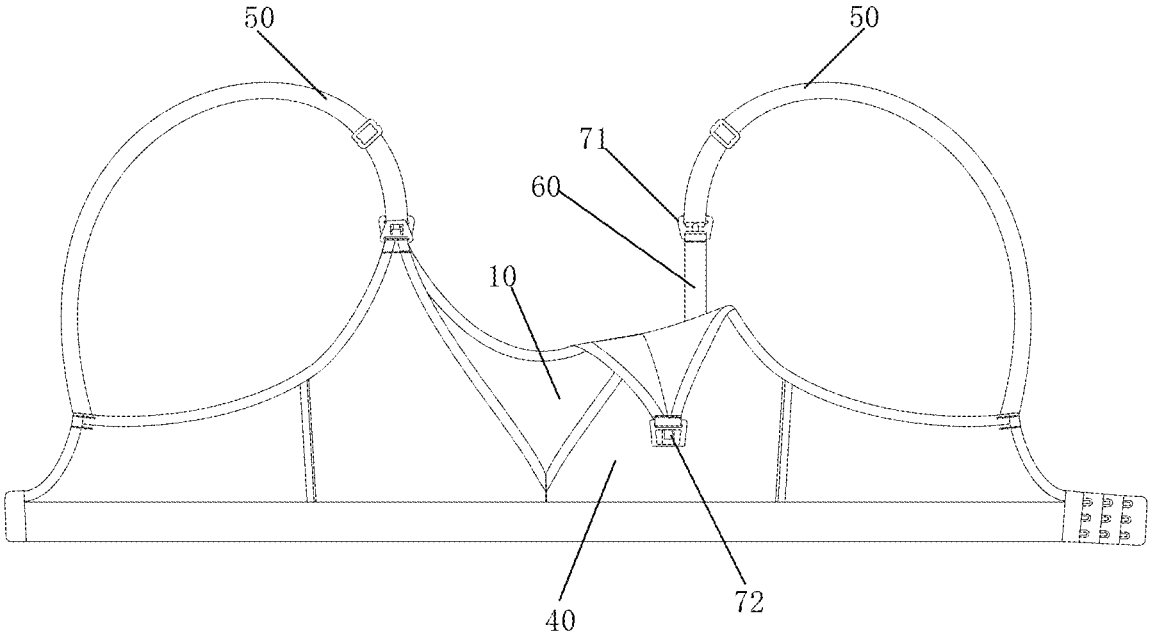
FIG. 9 is a schematic view illustrating a nursing state of the garment according to the first embodiment of the present application.
Figure 10:
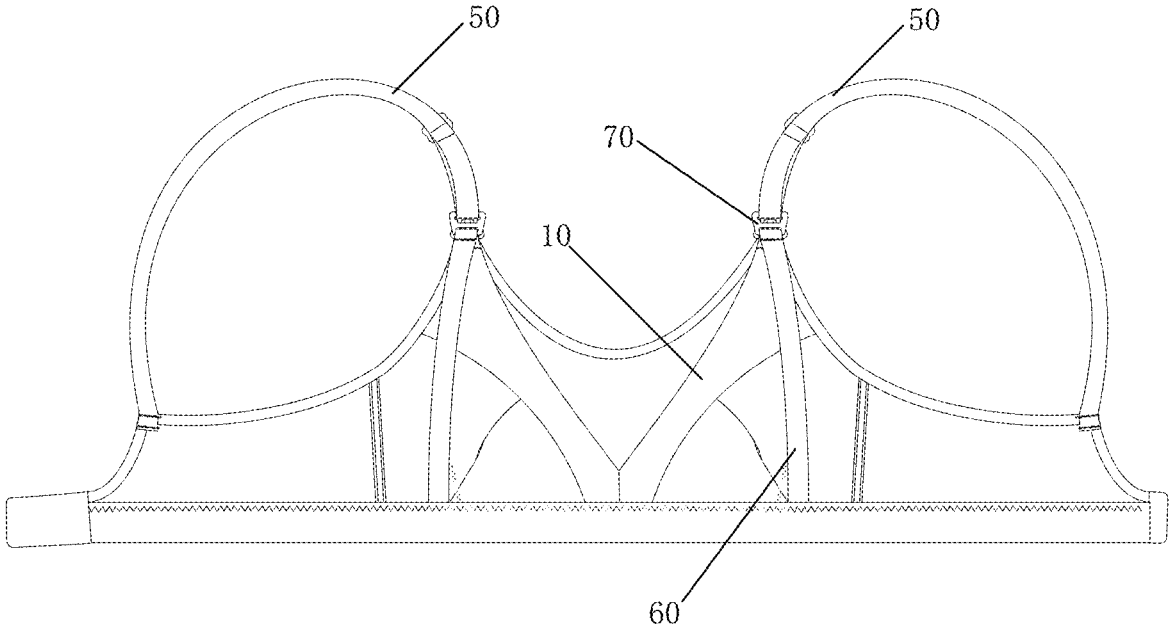
FIG. 10 is a schematic rear view of the garment according to the first embodiment of the present application.
Figure 11:
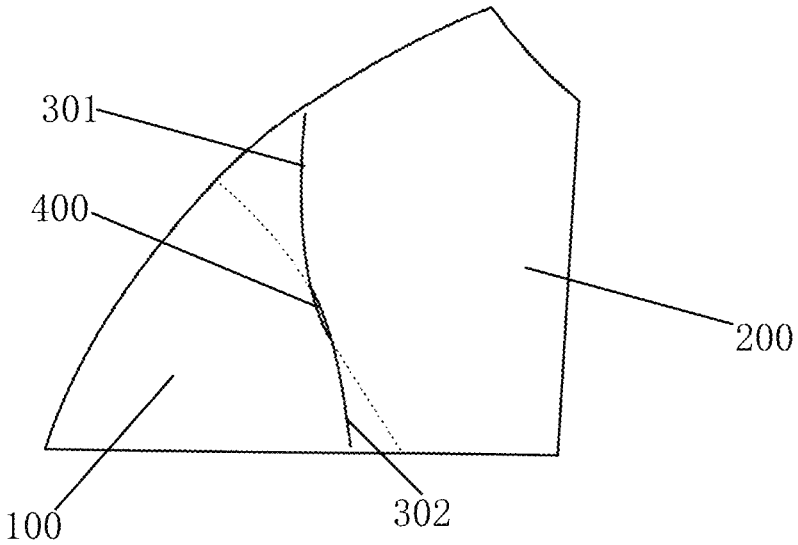
FIG. 11 is a partial schematic view of a breast pump functional layer of a garment corresponding to one breast, according to a second embodiment of the present application.
Figure 12:
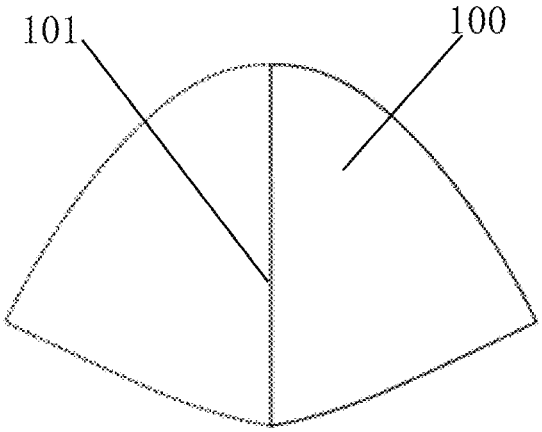
FIG. 12 is a schematic view illustrating a first panel being folded along a first edge according to the second embodiment of the present application.
Figure 13:
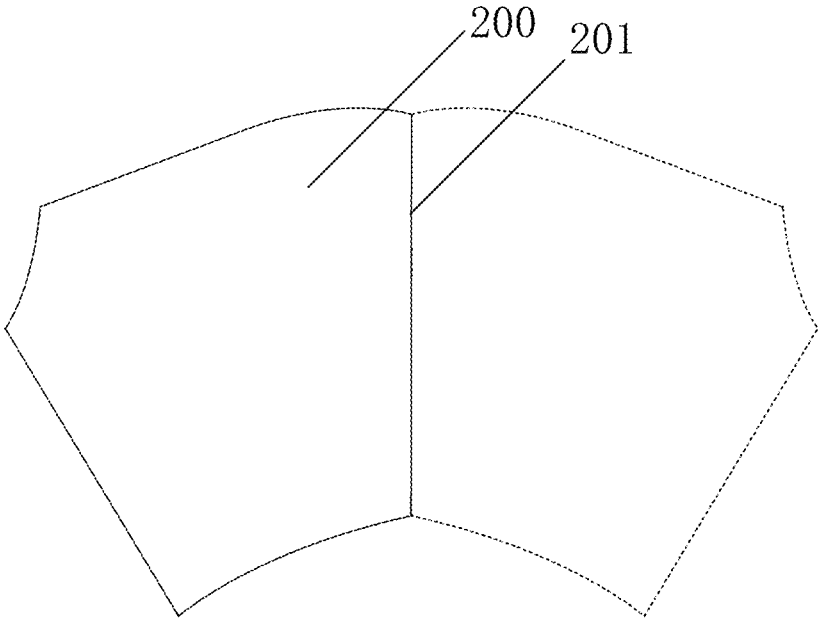
FIG. 13 is a schematic view illustrating a second panel being folded along a second edge according to the second embodiment of the present application.

Please refer to FIG. 1 to FIG. 13. FIG. 1 is a schematic front view of a breast pump functional layer according to a first embodiment of the present application. FIG. 2 is an exploded schematic view of a first panel, a second panel, and a third panel according to the first embodiment of the present application. FIG. 3 is a schematic rear view of the breast pump functional layer according to the first embodiment. FIG. 4 is a schematic view illustrating a joining manner between the second panel and the third panel according to the first embodiment. FIG. 5 is a schematic view illustrating the second panel being folded along a first edge according to the first embodiment. FIG. 6 is a schematic view illustrating the third panel being folded along a second edge according to the first embodiment. FIG. 7 is a schematic structural view of a garment in a daily wearing state according to the first embodiment. FIG. 8 is a schematic view illustrating a pumping state of the garment according to the first embodiment. FIG. 9 is a schematic view illustrating a nursing state of the garment according to the first embodiment. FIG. 10 is a schematic rear view of the garment according to the first embodiment. FIG. 11 is a partial schematic view of a breast pump functional layer of a garment corresponding to one breast according to a second embodiment of the present application. FIG. 12 is a schematic view illustrating a first panel being folded along a first edge according to the second embodiment. FIG. 13 is a schematic view illustrating a second panel being folded along a second edge according to the second embodiment.

As shown in FIG. 1, FIG. 2, FIG. 3, FIG. 4, and FIG. 8, a garment according to an embodiment of the present application comprises a breast pump functional layer 10. The breast pump functional layer 10 includes a first panel 11, a second panel 12, and a third panel 13. The first panel 11 is joined to the second panel 12, forming a first seam 14 at the joining region. The first panel 11 is joined to the third panel 13, forming a second seam 15 at the joining region. The second panel 12 and the third panel 13 are joined to the same side edge of the first panel 11, and are positioned on the same side of the first panel 11. The second panel 12 and the third panel 13 are joined at least partially, forming a third seam 16 at the joining region, with an opening 17 formed at a non-joined region. The opening 17 is configured to allow at least a portion of a breast pump 20 to pass through the opening 17 for pumping milk, the second panel 12 and the third panel 13 are configured to provide support to the breast pump when at least a portion of the breast pump is inserted into the opening 17. The aforementioned joining manner may be stitching or bonding with an adhesive, which is not limited in the embodiments of the present application. The first panel 11, the second panel 12, and the third panel 13 may be fabric materials, such as nylon-spandex fabric, polyester-spandex fabric, cotton fabric, and the like.

As shown in FIG. 1 and FIG. 8, the at least a portion of the breast pump 20 may refer to a breast shield of the breast pump. After the breast shield is inserted through the opening 17 and brought close to the human breast, the breast pump functional layer 10 presses and holds the breast shield of the breast pump against the human breast, thereby enabling hands-free pumping. In some embodiments, at least a portion of the breast pump 20 may also refer to the location where the breast shield of the breast pump connects to the milk storage container or other adjacent locations, and such aspects are not limited in the embodiments of the present application.

As shown in FIG. 1 and FIG. 2, the quantity of each of the first panel 11, the second panel 12, and the third panel 13 is two. The two first panels 11 are arranged symmetrically left and right, the two second panels 12 are arranged symmetrically left and right, and the two third panels 13 are arranged symmetrically left and right. A left-side set of the first panel 11, the second panel 12, and the third panel 13 corresponds to the right breast of the wearer, while a right-side set of the first panel 11, the second panel 12, and the third panel 13 corresponds to the left breast of the wearer.

Through the three-dimensional tailoring constituted by the joint splicing of the first panel 11, the second panel 12, and the third panel 13, the breast pump functional layer 10 facilitates the design of cup capacity. It can be assembled as needed to form breast pump functional layers adapted to different breast shapes, creating a space with sufficient depth that conforms to the natural contour of the breast. This effectively avoids the chest flattening and sense of pressure caused by traditional two-panel structures, resulting in a more aesthetically pleasing and comfortable breast shape when worn. Meanwhile, the opening 17 is positioned between the second panel 12 and the third panel 13, which reduces the risk of nipple pinching and friction, thereby enhancing wearing comfort. Consequently, while ensuring the supporting functionality of the opening, this configuration facilitates the design of breast containment capacity for the breast pump functional layer and improves overall wearing comfort. The position of the opening 17 is configured to approximately correspond to the location of the human nipple when worn.

As shown in FIG. 1 and FIG. 8, in one embodiment, the opening 17 is formed solely between the second panel 12 and the third panel 13. Compared to the conventional approach where an opening is formed at the convergence of three panels, positioning the opening 17 solely between the second panel 12 and the third panel 13 can reduce the risk of friction against or pinching of the nipple.

As shown in FIG. 1, in one embodiment, the first seam 14 and the second seam 15 are connected with a smooth transition.

As shown in FIG. 1, in one embodiment, the breast pump functional layer 10 has an underarm edge 18 adjacent to a wearer's underarm when worn. The first seam 14 extends from a lower edge 19 of the breast pump functional layer 10 to a position adjacent to a first end 151 of the second seam 15. The second seam 15 extends from the first end 151 to the underarm edge 18 of the breast pump functional layer 10.

As shown in FIG. 1, in one embodiment, both the first seam 14 and the second seam 15 are curved. The first panel 11, the second panel 12, and the third panel 13 are joined to form the breast pump functional layer 10 having an outwardly convex bowl shape. "Outwardly convex" refers to protruding outward in a direction away from the human body. The space formed by the outwardly convex bowl shape of the breast pump functional layer 10 is intended to receive the wearer's breast. This convex effect is manifested only when the garment is worn on the human body and is therefore not explicitly shown in the drawings. However, a person skilled in the art can clearly understand it in conjunction with the provided figures and textual description. This three-panel joining manner facilitates the design of convexity and cup capacity. The specific cup capacity can be designed according to user requirements. The present application does not specifically limit the degree of convexity or the size of the cup capacity. In other words, even a flattened breast pump functional layer structure achieved through three-panel joining falls within the protection scope of the present application, which primarily defines the three-panel joining manner. The outwardly convex form of the breast pump functional layer using three-panel joining is merely a preferred embodiment. By designing the first seam 14 and the second seam 15 as curved, the cup capacity of the assembled breast pump functional layer 10 can be enhanced, avoiding flattening of the breast pump functional layer 10 and improving wearing comfort. Optionally, the curvature of the first seam 14 protrudes toward the neckline edge 31 of the breast pump functional layer 10, and the curvature of the second seam 15 also protrudes toward the neckline edge 31 of the breast pump functional layer 10.

As shown in FIG. 1 and FIG. 4, in one embodiment, the second panel 12 and the third panel 13 at least partially overlap at a location of the opening 17 or at locations adjacent to two ends of the opening 17. By having the second panel 12 and the third panel 13 at least partially overlap at the location of the opening 17 or near its ends, the supporting effect of the opening 17 on the breast pump 20 can be enhanced, improving the stability of the support.

As shown in FIG. 1 and FIG. 4, in one embodiment, the third seam 16 comprises a first sub-seam 161 and a second sub-seam 162. The opening 17 is formed between the first sub-seam 161 and the second sub-seam 162. At the location of the first sub-seam 161, the second panel 12 is on an outer side of the third panel 13. At the location of the second sub-seam 162, the second panel 12 is on an inner side of the third panel 13. The design, wherein the second panel 12 and the third panel 13 are interleaved on the outer and inner sides at the location of the opening 17, can enhance the stability with which the opening 17 supports the breast pump 20. Herein, "inner side" refers to the side closer to the wearer's skin when worn, and "outer side" refers to the side farther from the wearer's skin when worn. In some embodiments, the interleaving manner may be reversed while achieving the same effect. For example, at the first sub-seam, the second panel may be on the inner side of the third panel, and at the second sub-seam, the second panel may be on the outer side of the third panel. The present application does not limit this aspect. The positions of the first sub-seam 161 and the second sub-seam 162 may be joined by stitching or bonding. To enhance support stability, stitching is preferred herein for the joining.

As shown in FIG. 2, FIG. 5, and FIG. 6, in one embodiment, the second panel 12 has a first edge 121 adjacent to the third panel 13, and the third panel 13 has a second edge 131 adjacent to the second panel 12. The opening 17 is formed between the first edge 121 and the second edge 131. The second panel 12 is formed by folding a fabric along the first edge 121, and the third panel 13 is formed by folding another fabric along the second edge 131, thereby reducing friction of the first edge 121 and the second edge 131 against the wearer's nipple. Through the above-described manner, the first edge 121 and the second edge 131 on both sides of the opening 17 are uncut and do not leave roughened edges, thereby minimizing friction between the fabric on both sides of the opening 17 and the human nipple and enhancing comfort.

As shown in FIG. 3, in one embodiment, the breast pump functional layer 10 further comprises a fourth panel 30, also referred to as a support panel 30. The fourth panel 30 at least partially overlaps with the breast pump functional layer 10. Specifically, the fourth panel 30 is disposed to at least partially overlap with the first panel 11 and the third panel 13. The fourth panel 30 does not cover the opening 17. The elastic modulus of the fourth panel 30 is greater than the elastic modulus of the breast pump functional layer 10, specifically greater than the elastic moduli of the first panel 11, the second panel 12, and the third panel 13. The function of the fourth panel 30 is to enhance the overall resistance to stretching of the breast pump functional layer 10, preventing significant deformation of the breast pump functional layer 10 during support of the breast pump 20, which could lead to aesthetic and comfort issues. An upper end of the fourth panel 30 may be joined to the neckline edge 31 or the underarm edge 18, and a lower end may be joined to a lower edge of the breast pump functional layer. The specific joining manner may be stitching or adhesive bonding, which is not limited in the embodiments of the present application.

As shown in FIG. 3, in one embodiment, the fourth panel 30 is joined to the breast pump functional layer 10 at least at a junction 138 of the neckline edge 31 and the underarm edge 18 of the breast pump functional layer 10. This location 138 is where a shoulder strap 50 is connected and serves as a key load-bearing point, thereby minimizing deformation during the support of the breast pump 20 as much as possible.

As shown in FIG. 7, FIG. 8, and FIG. 9, in one embodiment, the garment further comprises a cover layer 40. A portion of the cover layer 40 is connected to the breast pump functional layer 10. The cover layer 40 is disposed to be stacked with the breast pump functional layer 10. The cover layer 40 is configured to at least partially cover the opening 17, and the cover layer 40 is capable of being pulled open under an external force to expose the opening 17. A partial edge 41 of the cover layer 40 is joined to the breast pump functional layer 10, and the joining manner may be stitching or adhesive bonding. A partial edge 42 of the cover layer 40 is not joined to the breast pump functional layer 10, thereby allowing the cover layer 40 to be pulled open along the edge 42 to expose the opening 17.

As shown in FIG. 7, FIG. 8, FIG. 9, and FIG. 10, in one embodiment, the garment further comprises shoulder straps 50. The number of shoulder straps 50 is two, respectively corresponding to the left and right shoulders of the wearer. The cover layer 40 and the breast pump functional layer 10 are together detachably connectable to the shoulder straps 50. The detachable connection may be implemented through a clasp assembly 70. For example, the clasp assembly 70 comprises a first clasp 71 provided on the shoulder strap 50 and a second clasp 72 provided at an upper portion of the cover layer 40 and the breast pump functional layer 10, achieving the detachable connection. Specifically, the first clasp 71 is provided with a hook, and the second clasp 72 is provided with a slot. Connection is achieved when the hook engages the slot, and disconnection is achieved when the hook is disengaged from the slot. Of course, this is merely one example of a detachable connection. It will be readily understood by those skilled in the art that the positions of the hook and the slot may be interchanged.

In the embodiments of the present application, the garment may take the form of a bra, top, shirt, vest, camisole, nightgown, dress, or other types of women's clothing, and is not limited to the bra shown in the drawings. Specifically, the garment may be a nursing bra, nursing top, nursing shirt, nursing vest, nursing camisole, nursing nightgown, nursing dress, or other women's garment used for nursing. Alternatively, the garment may be a breast-pump bra, breast-pump top, breast-pump shirt, breast-pump vest, breast-pump camisole, breast-pump nightgown, breast-pump dress, or other women's garment used for supporting a breast pump. Furthermore, the garment may also integrate both breast-pump and nursing functions, such as a breast-pump/nursing bra, breast-pump/nursing top, breast-pump/nursing shirt, breast-pump/nursing vest, breast-pump/nursing camisole, breast-pump/nursing nightgown, breast-pump/nursing dress, or other women's garment used for supporting a breast pump or nursing. The garment is configured to allow a nursing woman to pump milk or breastfeed without removing the garment.

As shown in FIG. 9 and FIG. 10, in one embodiment, the garment further comprises a support strap 60, wherein an upper end of the support strap 60 is connected to the shoulder strap 50, and a lower end of the support strap 60 is connected to the breast pump functional layer 10 or the cover layer 40.

Usage scenarios of a garment according to one embodiment of the present application are described below.

Daily Wearing Scenario: As shown in FIG. 7, the cover layer 40 and the breast pump functional layer 10 are connected to the shoulder straps 50.

Breast Pump Usage Scenario: As shown in FIG. 8, the user pulls open the cover layer 40 to expose the opening 17, inserts the breast pump 20 through the opening 17 to approach the wearer's breast, and the opening 17 supports the breast pump for milk pumping.

Nursing Scenario: As shown in FIG. 9, the cover layer 40 and the breast pump functional layer 10 are together detached from the shoulder straps 50. The lower part of the garment is supported by the support strap 60 and the shoulder straps 50, allowing the user's breast to be exposed for breastfeeding.

As shown in FIG. 11, in another embodiment of the present application, the garment comprises abreast pump functional layer, the breast pump functional layer comprising a first panel 100 and a second panel 200. The first panel 100 and the second panel 200 are joined at least partially at a joining region forming a seam, and an opening 400 is formed at a non-joined region. The opening 400 is configured to allow at least a portion of a breast pump to pass therethrough for pumping milk, the first panel 100 and the second panel 200 are configured to provide support to the breast pump when at least a portion of the breast pump is inserted into the opening 400. The first panel 100 and the second panel 200 at least partially overlap at a location of the opening 400 or at locations adjacent to two ends of the opening 400.

As shown in FIG. 11, the seam comprises a first sub-seam 301 and a second sub-seam 302. The opening 400 is formed between the first sub-seam 301 and the second sub-seam 302. At the location of the first sub-seam 301, the first panel 100 is on an outer side of the second panel 200. At the location of the second sub-seam 302, the first panel 100 is on an inner side of the second panel 200.

As shown in FIG. 12 and FIG. 13, in one embodiment, the first panel 100 has a first edge 101 adjacent to the second panel 200, and the second panel 200 has a second edge 201 adjacent to the first panel 100. The opening 400 is formed between the first edge 101 and the second edge 201. The first panel 100 is formed by folding a fabric along the first edge 101, and the second panel 200 is formed by folding another fabric along the second edge 201, thereby reducing friction of the first edge 101 and the second edge 201 against a wearer's nipple.

In the embodiments of the present application, the garment is configured to include a breast pump functional layer, which comprises a first panel, a second panel, and a third panel. The first panel is joined to the second panel to form a first seam at the joining region, and the first panel is joined to the third panel to form a second seam at the joining region. The second panel and the third panel are joined to the same side edge of the first panel. The second panel and the third panel are joined at least partially to form a third seam at the joining region, with an opening formed at the non-joined region. The opening is configured to allow at least a portion of a breast pump to pass therethrough for pumping milk, the second panel and the third panel are configured to provide support to the breast pump when at least a portion of the breast pump is inserted into the opening. By employing three-dimensional tailoring constituted through the joint splicing of the first, second, and third panels, the breast pump functional layer facilitates the design of cup capacity. It can be assembled as needed to fit different breast shapes, forming a space with sufficient depth that conforms to the natural contour of the breast. This effectively avoids the chest flattening and sense of pressure caused by traditional two-panel structures, resulting in a more aesthetically pleasing and comfortable breast shape when worn. Simultaneously, by positioning the opening for breast pump support between the second and third panels, the risk of nipple pinching and friction is reduced, thereby enhancing wearing comfort. Consequently, this configuration ensures the supporting functionality of the opening while facilitating the design of breast containment capacity for the breast pump functional layer and improving overall wearing comfort.

While certain features of the embodiments of the subject matter claimed have been illustrated and described herein, many modifications, substitutions, changes, and equivalents will now occur to those skilled in the art. Moreover, although several functional modules and their relationships have been described in detail, it is believed by those skilled in the art that some operations can be performed without using other functional modules, or other functions or relationships between functions can be established while still conforming to the subject matter claimed. Therefore, it is intended that the appended claims encompass all such modifications and variations that fall within the true spirit and scope of the embodiments of the claimed subject matter.

The above description only provides specific embodiments of the present application. It should be noted that for ordinary technicians in the technical field, without departing from the principles of the present application, several improvements and embellishments can also be made, which should also be regarded as falling within the protection scope of the present application.

What is claimed is:

1. A garment comprising:

a breast pump functional layer and a cover layer, the breast pump functional layer comprising a first panel, a second panel, and a third panel;

the first panel is joined to the second panel to form a first seam;

the first panel is joined to the third panel to form a second seam;

the second panel and the third panel are joined to a same side edge of the first panel;

the second panel and the third panel are joined at least partially to form a third seam, and an opening is formed at a non-joined region; and wherein the opening is configured to allow at least a portion of a breast pump to pass through the opening for milk pumping, the second panel and the third panel are configured to provide support to the breast pump when at least a portion of the breast pump is inserted into the opening;

wherein a portion of the cover layer is connected to the breast pump functional layer, the cover layer is disposed to be stacked with the breast pump functional layer, the cover layer is configured to at least partially cover the opening, and the cover layer is capable of being pulled open under an external force to expose the opening.

2. The garment of claim 1, wherein the opening is formed solely between the second panel and the third panel.

3. The garment of claim 1, wherein the first seam and the second seam are connected with a smooth transition.

4. The garment of claim 1, wherein the breast pump functional layer has an underarm edge adjacent to a wearer's underarm when worn, and wherein the first seam extends from a lower edge of the breast pump functional layer to a position adjacent to a first end of the second seam, and the second seam extends from the first end to the underarm edge of the breast pump functional layer.

5. The garment of claim 1, wherein the first seam and the second seam are both curved, and wherein the first panel, the second panel, and the third panel are joined to form the breast pump functional layer having an outwardly convex bowl shape.

6. The garment of claim 1, wherein the second panel and the third panel at least partially overlap at a location of the opening or at locations adjacent to two ends of the opening.

7. The garment of claim 1, wherein the third seam comprises a first sub-seam and a second sub-seam, the opening is formed between the first sub-seam and the second sub-seam, at the first sub-seam the second panel is on an outer side of the third panel, and at the second sub-seam the second panel is on an inner side of the third panel.

8. The garment of claim 1, wherein:

the second panel has a first edge adjacent to the third panel, and the third panel has a second edge adjacent to the second panel;

the opening is formed between the first edge and the second edge;

the second panel is formed by folding a fabric along the first edge; and the third panel is formed by folding another fabric along the second edge, thereby reducing friction of the first edge and the second edge against a wearer's nipple.

9. The garment of claim 1, wherein the breast pump functional layer further comprises a fourth panel, the fourth panel is disposed to at least partially overlap with the first panel and the third panel, the fourth panel does not cover the opening, and an elastic modulus of the fourth panel is greater than elastic moduli of the first panel, the second panel, and the third panel.

10. The garment of claim 9, wherein the fourth panel is joined to the breast pump functional layer at least at a junction of a neckline edge and the underarm edge of the breast pump functional layer.

11. The garment of claim 1, further comprising a shoulder strap, wherein the cover layer and the breast pump functional layer are together detachably connectable to the shoulder strap.

12. The garment of claim 11, further comprising a support strap, wherein an upper end of the support strap is connected to the shoulder strap, and a lower end of the support strap is connected to the breast pump functional layer or the cover layer.

13. A garment comprising:

a breast pump functional layer, the breast pump functional layer comprising a first panel and a second panel;

wherein the first panel and the second panel are joined at least partially to form a seam, and an opening is formed at a non-joined region;

wherein the opening is configured to allow at least a portion of a breast pump to pass through the opening for milk pumping, the first panel and the second panel are configured to provide support to the breast pump when at least a portion of the breast pump is inserted into the opening; and wherein the first panel and the second panel at least partially overlap at a location of the opening or at locations adjacent to two ends of the opening;

wherein the seam comprises a first sub-seam and a second sub-seam, the opening is formed between the first sub-seam and the second sub-seam, at the first sub-seam the first panel is on an outer side of the second panel, and at the second sub-seam the first panel is on an inner side of the second panel.

14. The garment of claim 13, wherein:

the first panel has a first edge adjacent to the second panel, and the second panel has a second edge adjacent to the first panel;

the opening is formed between the first edge and the second edge;

the first panel is formed by folding a fabric along the first edge; and the second panel is formed by folding another fabric along the second edge, thereby reducing friction of the first edge and the second edge against a wearer's nipple.

15. A garment comprising:

a breast pump functional layer having an opening formed therein, the opening configured to allow at least a portion of a breast pump to pass through the opening for milk pumping, the breast pump functional layer is configured to provide support to the breast pump when at least a portion of the breast pump is inserted into the opening; and a support panel disposed to at least partially overlap with the breast pump functional layer;

wherein the support panel does not cover the opening; and wherein an elastic modulus of the support panel is greater than an elastic modulus of the breast pump functional layer.

16. The garment of claim 15, wherein the support panel is joined to the breast pump functional layer at least at a junction of a neckline edge and an underarm edge of the breast pump functional layer.

17. The garment of claim 15, wherein the breast pump functional layer comprises:

a first panel, a second panel, and a third panel;

wherein the first panel is joined to the second panel to form a first seam;

wherein the first panel is joined to the third panel to form a second seam;

wherein the second panel and the third panel are joined to a same side edge of the first panel; and wherein the second panel and the third panel are joined at least partially to form a third seam, and the opening is formed at a non-joined region.

18. The garment of claim 15, wherein the support panel is disposed to at least partially overlap with the first panel and the third panel of the breast pump functional layer.

* * * * *